US007659491B2

(12) United States Patent
Yang

(10) Patent No.: US 7,659,491 B2
(45) Date of Patent: Feb. 9, 2010

(54) REFRIGERATOR DOOR AND REFRIGERATOR THEREWITH

(75) Inventor: Chang Woan Yang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/275,335

(22) Filed: Dec. 23, 2005

(65) Prior Publication Data

US 2006/0138124 A1 Jun. 29, 2006

(30) Foreign Application Priority Data

Dec. 28, 2004 (KR) ..... 10-2004-0113731

(51) Int. Cl.
*F25D 21/06* (2006.01)
*H05B 3/10* (2006.01)

(52) U.S. Cl. ..... 219/201; 219/218; 62/440; 62/275; 292/251.5

(58) Field of Classification Search ..... 219/201, 219/218; 62/248, 440; 292/251.5
See application file for complete search history.

(56) References Cited

U.S. PATENT DOCUMENTS 3,038,319 A * 6/1962 Kesling ..... 62/275
3,055,193 A * 9/1962 Smith ..... 62/440
3,248,159 A 4/1966 Hall
4,127,765 A * 11/1978 Heaney ..... 219/218
4,142,092 A * 2/1979 Abrams ..... 219/218
4,416,086 A * 11/1983 Niekrasz ..... 49/388
5,048,233 A * 9/1991 Gidseg et al. ..... 49/501
6,301,913 B1 * 10/2001 Schulak et al. ..... 62/248
6,655,766 B2 * 12/2003 Hodges ..... 312/406.2
6,931,863 B2 * 8/2005 Chen et al. ..... 62/6
7,008,032 B2 * 3/2006 Chekal et al. ..... 312/405
2005/0091999 A1 * 5/2005 Chen ..... 62/176.1

* cited by examiner

*Primary Examiner*—Tu B Hoang
*Assistant Examiner*—Vinod D Patel
(74) *Attorney, Agent, or Firm*—Fish & Richardson P.C.

(57) ABSTRACT

The present invention relates to a refrigerator door which can prevent vapor condensation on one side thereof, and a refrigerator therewith. To achieve this, the present invention provides a refrigerator door including one pair of door bodies rotatably connected to a refrigerator body; and a heating device provided to at least one of ends of the door bodies facing each other in a state the door bodies are closed, for prevention of vapor condensation on the ends of the door bodies; and a refrigerator therewith, thereby preventing vapor condensation on one side of the door, permitting the user to use the refrigerator with comfort.

20 Claims, 5 Drawing Sheets

REFRIGERATOR DOOR AND REFRIGERATOR THEREWITH

CROSS-REFERENCE TO RELATED APPLICATION

This application claims the benefit of Korean Application No. P2004-113731, filed on Dec. 28, 2004, which is hereby incorporated by reference as if fully set forth herein.

BACKGROUND OF THE INVENTION

1. Field of the Invention

The present invention relates to refrigerators, and more particularly, to a refrigerator door which can prevent vapor condensation thereon, and a refrigerator therewith.

2. Discussion of the Related Art

In general, the refrigerator, an appliance for storing food at a low temperature, stores the food at a frozen state or a cold state depending on kinds of food. Cold air supplied to the refrigerator is produced by heat exchange action of refrigerant continuously as the refrigerant is compressed, condensed, expanded, and evaporated repeatedly, and the cold air supplied thus is delivered throughout an inside of the refrigerator uniformly by convection, to enable to store the food at a desired temperature.

A related art refrigerator will be described with reference to FIGS. 1 and 2.

Referring to FIG. 1, there is a body 10 of the refrigerator provided with a refrigerating chamber 20 for low temperature storage of food, and a freezing chamber 30 for frozen storage of food on an upper side and a lower side thereof, respectively.

The refrigerating chamber 20 and the freezing chamber 30, spaces independent from each other, have fronts to be opened, respectively. The fronts are opened/closed with doors 40, 50, and 60 selectively. In the doors 40, 50, and 60, there are upper doors 40, and 50 for opening/closing the refrigerating chamber 20 on the upper side of the body 10, and a lower door 60 for opening/closing the freezing chamber 30 on a lower side of the body 10.

The upper doors 40, and 50 are rotatably secured to a left and a right of the body 10, for selective opening/closing of a front of the refrigerating chamber 20. On fronts of bodies 41, and 51 of the upper door, there are upper door handles 42, and 52 for easy holding of the upper doors 40, and 50 by the user.

At facing ends of the left, and right doors 41, and 51, there are gaskets 45, and 55 provided thereto for preventing cold air from leaking from the body 10 of the refrigerator to an outside of the refrigerator.

The lower side of the front of the refrigerator body 10, i.e., the front of the freezing chamber 30 is opened/closed with the lower door 60, selectively. The lower door 60 slides in front/rear directions, to open/close the freezing chamber 30 selectively, and there is a lower door handle 62 on the upper side of a lower door body 61 for easy holding of the lower door 60 by the user.

In the meantime, referring to FIG. 2, in the refrigerating chamber 20, there are a variety of drawers, baskets, and shelves, and so on suitable to various kinds of food for low temperature storage of various kinds of food.

Temperatures varies even in the same refrigerating chamber 20 or the freezing chamber 30 depending on positions thereof, owing to the drawers, baskets, shelves, and so on which partitions the space, leading a cold air flow to be changed within the refrigerator body 10.

The upper doors 40, and 50, opening/closing the front of the refrigerating chamber 20, are hinged at outer edges of the body 10 for opening/closing the refrigerating chamber 20 in left/rights.

Moreover, in the refrigerating chamber 20, there are a plurality of baskets and shelves for storage of food requiring cold storage. On outer circumferences of the upper doors 40, and 50, there are gaskets 45, and 55.

The gaskets 45, and 55 are configured such that the gaskets 45, and 55 are in contact with the other so that the gaskets 45, and 55 can close a gap between the upper door bodies 41, and 51 when the upper door bodies 41, and 51 are closed. For effective closure of the gaskets 45, and 55, it is preferable that the gaskets 45, and 55 are formed of elastic rubber, or silicone, each with a little upward protrusion.

The left, and right upper doors 40, and 50 are identical.

However, the related art door has the following problems.

The left, and right upper doors are brought into contact with each other only with the gaskets on the upper doors without any other structures. Since provision of members to portions the gaskets are in contact is not possible for insulation, the portions the gaskets are in contact are weak in insulation.

Moreover, in general, a temperature inside of the refrigerating chamber closed with the upper doors is low in comparison to a temperature of the room where the refrigerator is installed, significantly.

Consequently, there is a substantial difference of temperatures between an inside, and an outside of the upper doors due to minute leakage of cold air between gaskets in contact with each other, or a temperature difference between an inside, and an outside of the refrigerating chamber, to cause vapor condensation at one side of the upper door exposed to an outside of the refrigerator, i.e., on surfaces the left, and right upper doors are close to each other, to result in complaint of the user.

SUMMARY OF THE INVENTION

Accordingly, the present invention is directed to a refrigerator door, and a refrigerator therewith that substantially obviates one or more problems due to limitations and disadvantages of the related art.

An object of the present invention is to provide a refrigerator door, in which a heating device is provided to one side of door that close an opened front of a refrigerator body on both sides thereof, for preventing vapor condensation at one side of the door.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerator door includes one pair of door bodies rotatably connected to a refrigerator body; and a heating device provided to at least one of ends of the door bodies facing each other in a state the door bodies are closed, for prevention of vapor condensation on the ends of the door bodies.

Preferably, the heating device includes a heat generating portion for generating heat, and a base portion for making uniform distribution of the heat from the heat generating portion throughout the end of the door body. More preferably, the heat generating portion is constructed of hot-wire.

In the meantime, the heat generating portion may be provided to one side of the base portion, so as to be in contact with the base portion. The base portion may have grooves for receiving the heat generating portion.

Preferably, the base portion is formed of aluminum. More preferably, the heating device is on facing ends of the door bodies in an up/down direction.

In the meantime, preferably, the door bodies each include an outer case to form an exterior of the door body, and an inner case in rear of the outer case to form an interior of the door body.

In another aspect of the present invention, a refrigerator includes a refrigerator body having an opened front, and a refrigerator door for opening/closing the opened front of the refrigerator body, wherein the refrigerator door includes one pair of door bodies rotatably connected to the refrigerator body; and a heating device provided to at least one of ends of the door bodies facing each other in a state the door bodies are closed, for prevention of vapor condensation on the ends of the door bodies.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

The refrigerator in accordance with a preferred embodiment of the present invention will be described with reference to FIG. 3.

Figure 1:
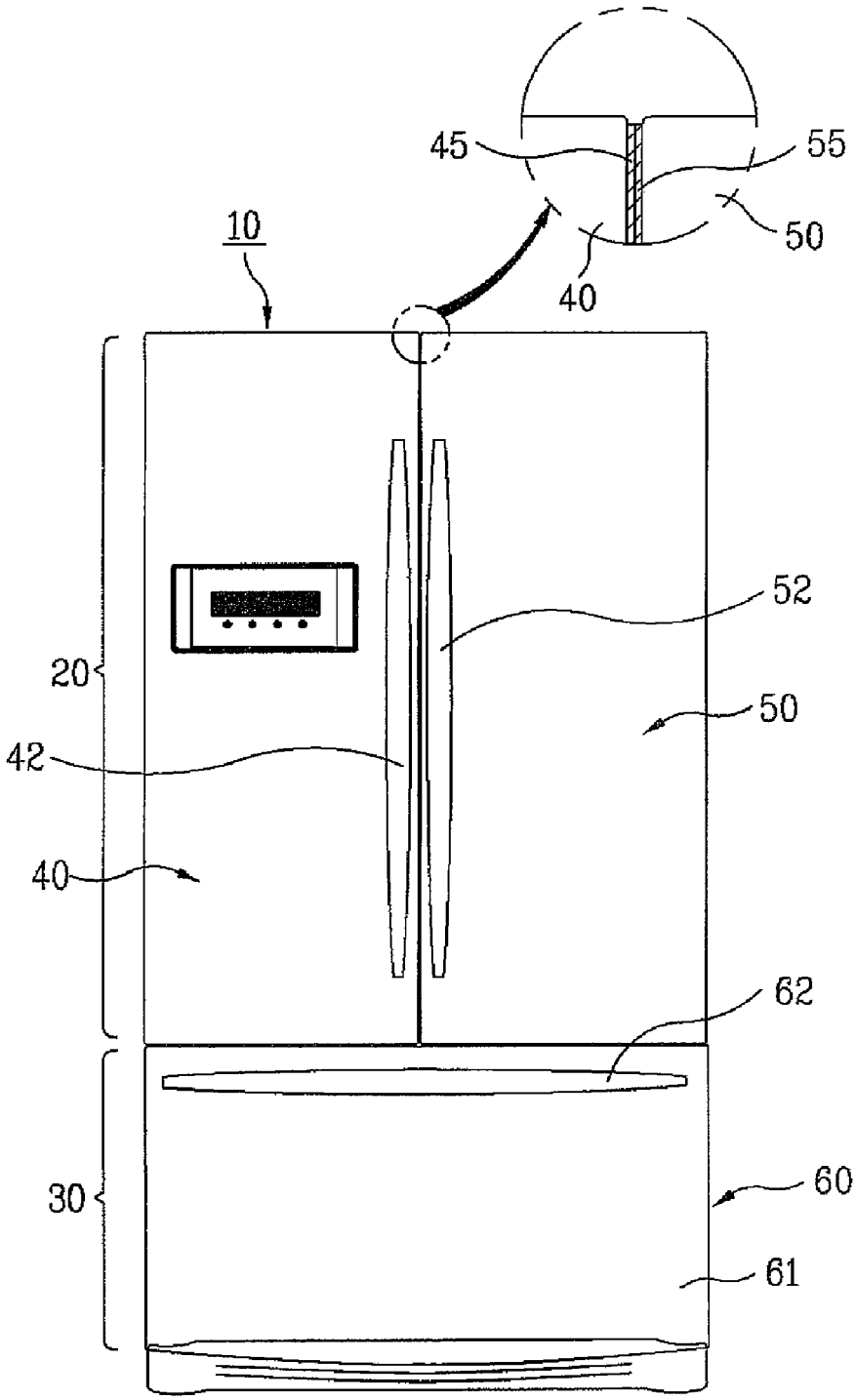
FIG. 1 Related Art
FIG. 1 illustrates a front view of a related art refrigerator.
Figure 2:
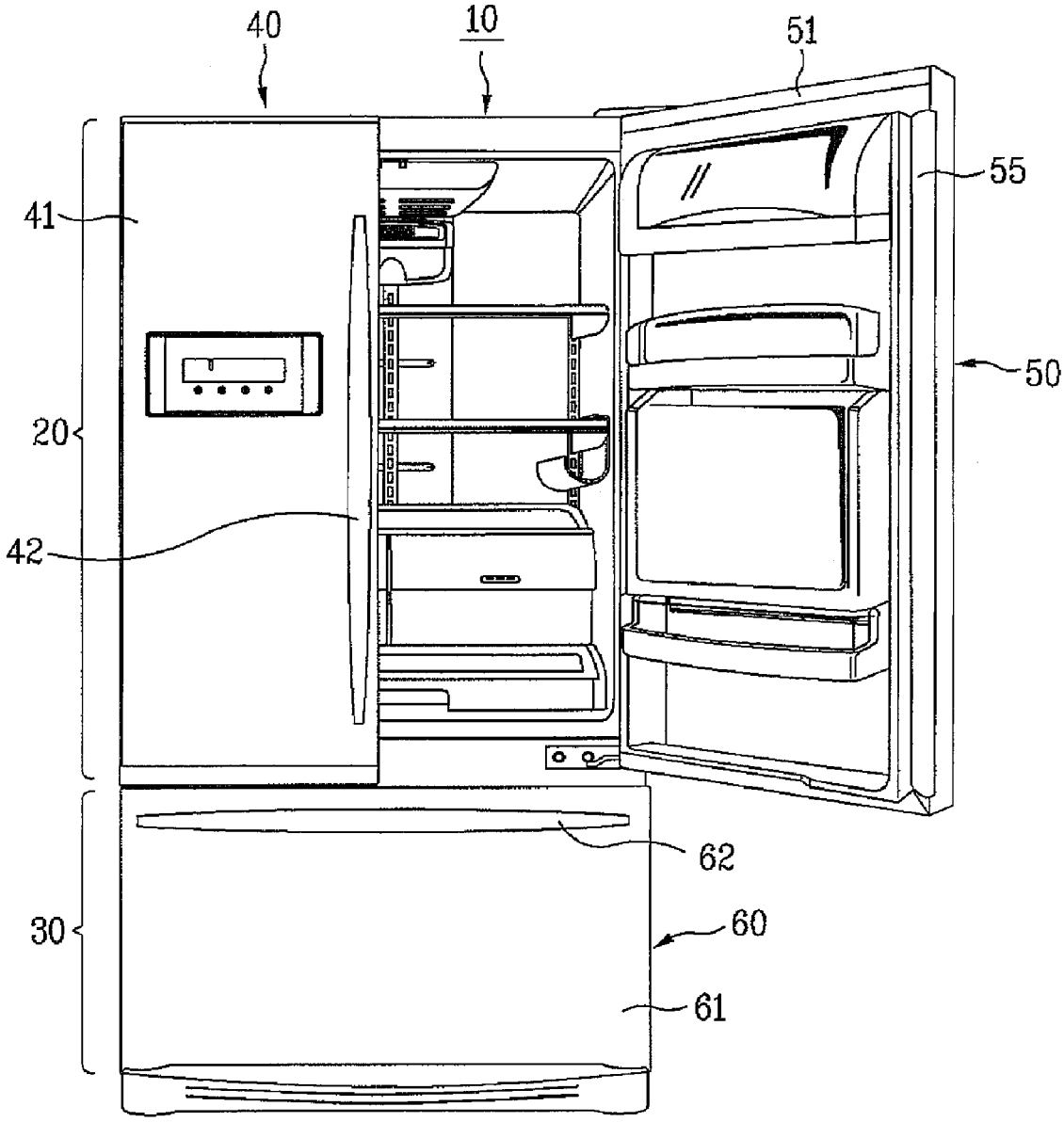
FIG. 2 Related Art
FIG. 2 illustrates a partial perspective view of a related art refrigerator, with a door opened.
Figure 3:
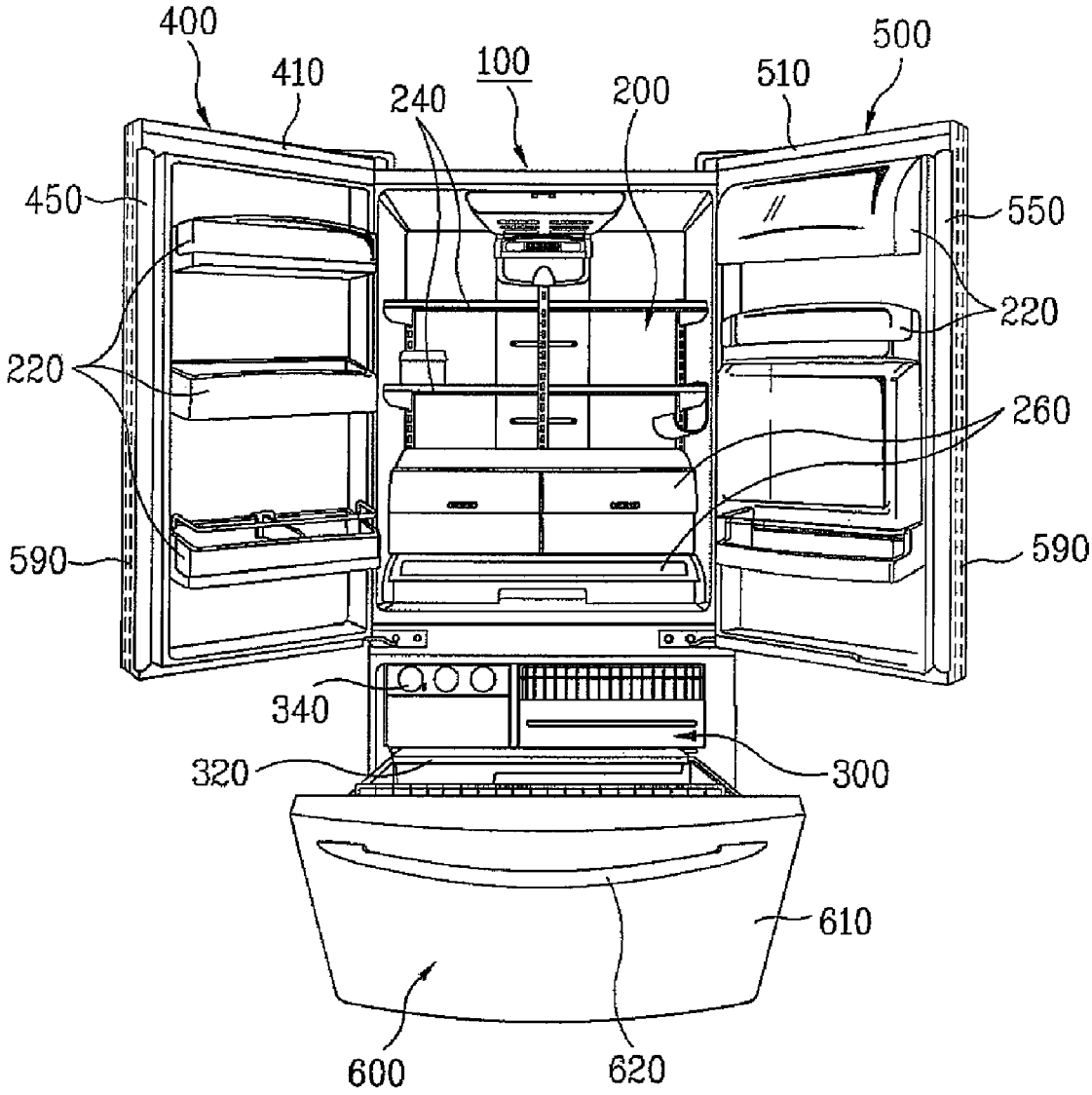
FIG. 3 illustrates a perspective view of a refrigerator having refrigerator doors in accordance with a preferred embodiment of the present invention applied thereto.

Referring to FIG. 3, an inside of a refrigerator body 100 is partitioned into a refrigerating chamber 200 and a freezing chamber 300.

In the refrigerating chamber 200, on an upper side of the refrigerator body 100, there are various shapes of baskets 220, shelves 240, and drawers 260, partitioning a space of the refrigerating chamber 200, for effective holding of various kinds of food.

Therefore, cold air supplied to one side of the refrigerator body 100 is influenced by the baskets 220, shelves 240, and drawers 260, to restrict or regulate convection of the cold air. Thus, the user is enabled to store food according to temperature characteristics caused by such a difference of cold air supply.

A front of the refrigerating chamber 200 is opened, and the opened front of the refrigerating chamber 200 is closed with the upper doors 400, and 500, selectively. The upper doors 400, and 500 are mounted on a left, and a right of the refrigerator body 100, with opposite edges of bodies 410, and 510 of the upper doors hinged at sides of the refrigerator body 100, enabling the doors to rotate in opposite directions, to close the refrigerating chamber 200, selectively.

In the meantime, there are heating devices 590 at facing ends of the door bodies 410, and 510 for prevention of vapor condensation. Detailed description of the heating device will be given later, with reference to FIG. 4.

Though not shown, on one side of the upper door bodies 410, and 510, there is a home bar for handy taking out of wine or drink as necessary or a dispenser for purifying water to enable to take out from an outside of the refrigerator, or a display and operation buttons for temperature indication, and display of a state of an inside of the refrigerator body 100.

In the meantime, in the freezing chamber 300 on the lower portion of the refrigerator body 100, there is fish, meat, or food required to be stored for a long time stored in a frozen state.

A lower door 600 includes a lower door body 610 provided on a front of the freezing chamber 300, for closing an inside of the freezing chamber 300. And a storage box 320 is fixed to a rear surface of the lower door body 610.

On one side of the lower door body 600, there is a lower door handle 620 for the user to make easy holding of the lower door 600. It is preferable that the lower door handle 620 is fixedly secured to an upper side of the lower door 600.

In the freezing chamber 300, there are drawers, or baskets, and so on for frozen storage of food sorted according to sizes or states of the food, and together with an ice maker 340 for making, and storing ice cubes.

The heating device on the refrigerator door will be described with reference to FIG. 4.

As the left, and right upper doors 400, and 500 are identical, for convenience of explanation, only the right upper door 500 will be described.

Figure 4:
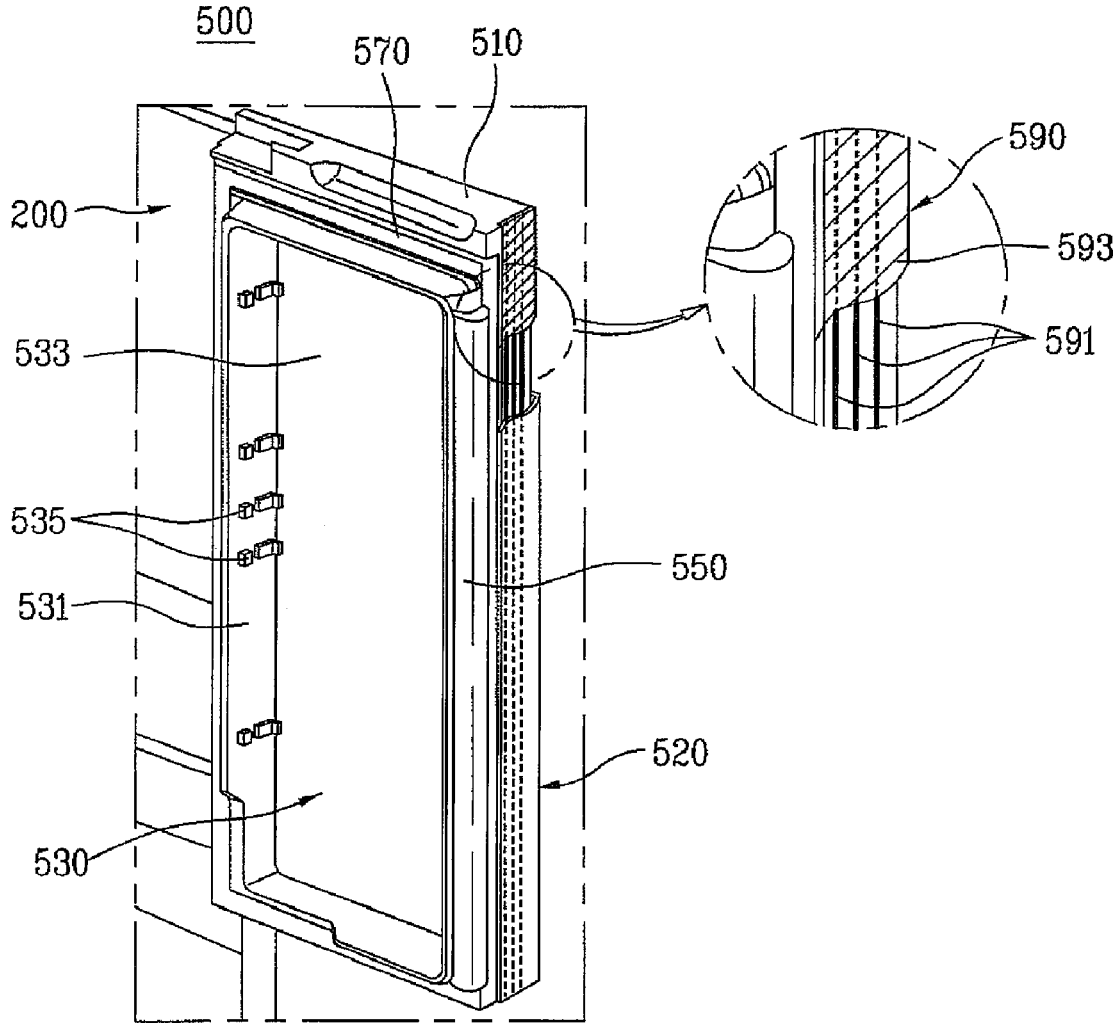
FIG. 4 illustrates a perspective view of a refrigerator door in accordance with a preferred embodiment of the present invention, with a partial cut away view.

Referring to FIG. 4, the upper door body 510, having a shape of a substantially rectangular board with a predetermined thickness, closes around a half of the refrigerating chamber 200.

The upper door body 510 includes an outer case 520 and an inner case 530, which form an exterior thereof. The outer case 520, forming an outer shape of the upper door 500, is in general constructed by bending a steel plate.

At an edge of the outer case 520 mating with one of left, and rights of an upper surface of the refrigerating chamber 200, there is a hinge for rotatable mounting of the upper door 500.

In the meantime, the inner case 530 is on an inner side of the upper door 500. The inner case 530 faces an inside of the refrigerating chamber 200 when the upper door 500 is closed so as to be invisible from an outside of the refrigerator. It is preferable that the inner case 530 is formed of synthetic plastic.

The inner case 530 is in rear of the outer case 520, with a size the inner case 530 can be adjoin to rear edges of the outer case 520, includes a rim 531 projected backward from a periphery of the inner case 530 to a predetermined height, and a cavity 533 on an inner side of the rim 531, to form a space.

On opposite insides of the rim 531, there are pluralities of mounting pieces 535 projected and exposed to the cavity 533. The mounting pieces 535 support mounting of storage spaces, such as the shelves, drawers, and so on which partition the cavity 533, for storage of food.

There is insulating material (not shown) stuffed between the outer case 520 and the inner case 530. The insulating material prevents the refrigerator from losing heat due to a temperature difference between an inside and outside of the refrigerator 200. A variety of materials can be used as the insulating material.

Outer edges of the inner case 530 and inner edges of the outer case 520 are in contact with each other, and a sealing member 570 is provided to a portion the edges are in contact, for sealing a gap between the inner case 530 and the outer case 520.

At facing ends of the left, and right upper door bodies 510, and 610 when the upper door bodies 500 close the refrigerating chamber 200, i.e., on sides of the inner cases 530 at a middle of the refrigerating chamber 200 when the upper door bodies 510 are closed, there are gaskets 550.

The gaskets 550 are formed of rubber, silicone, or so on having elasticity for making close contact with each other, and mounted so as to be projected outwardly from, sides of the inner cases 530, i.e., portions of the left, and right upper doors 500 which are brought into contact with each other when the left, and right upper doors 500 are rotated to close the opened portion of the refrigerating chamber 200.

In the meantime, the heating device 590 is provided to at least one of ends of the left and right upper door bodies 410, and 510 which face each other when the door bodies 410, and 510 are closed, i.e., the sides of the outer cases 520. The embodiment illustrates the heating devices 590 provided to the ends of the left, and right upper door bodies 410, and 510.

The heating device 590 is mounted so as to be in contact with an inside of the side of the outer case 520 along the side of the outer case 520 in an up/down direction, for heating the side of the outer case 520.

The heating device 590 includes a heat generating portion 591, and a base portion 593.

The heat generating portion 591 runs a plurality of times, or a plurality of separate pieces thereof run, on a surface of the base portion 593. The heat generating portion 591 may have various forms, and the embodiment shows the heat generating portion 591 constructed of hot-wire.

The heat generating portion 591 is in contact with an inner side surface of the base portion 593. The heat generating portion 591 may be attached to the base portion 593 with an adhesive.

The base portion 593, on an outer of the heat generating portion 591, distributes heat from the heat generating portion 591 to the end of the door body 510, uniformly. Therefore, it is preferable that the base portion 593 has a predetermined area, and formed of a material having a good heat conductivity, for uniform distribution of heat from the heat generating portion 591 to the end of the upper door body 510. The base portion 593 may be formed of, for an example, aluminum.

In the meantime, referring to FIG. 4, it is preferable that the outer case 520 is bent to sides where the refrigerator doors 510, and 610 face each other, to enclose the base portion 593. It is more preferable that the bent portion of the outer case 520 has a plurality of holes for good distribution of heat from the heat generating portion 591 to portions where the left, and right door bodies 410, and 510 face each other.

A variation of the heating device will be described with reference to FIG. 5.

A basic structure of the embodiment is identical to the foregoing embodiment. That is, in the embodiment too, the heating device 690 includes a heat generating portion 691, and a base portion 693, the heat generating portion 691 is constructed of hot-wire, and the heat from the heat generating portion 691 is distributed to the end of the upper door body 510 uniformly by the base portion 693.

However, in the embodiment, the heat generating portion 691 is mounted on an outer side surface of the base portion 693. Along with this, the base portion 693 has grooves for receiving the heat generating portion 691, thereby providing a space for mounting the heat generating portion 691 therein.

In the meantime, different from the embodiment, of course, it is also viable that the heating generating portion 691 is attached to an outer side surface of the base portion with an adhesive.

Figure 5:
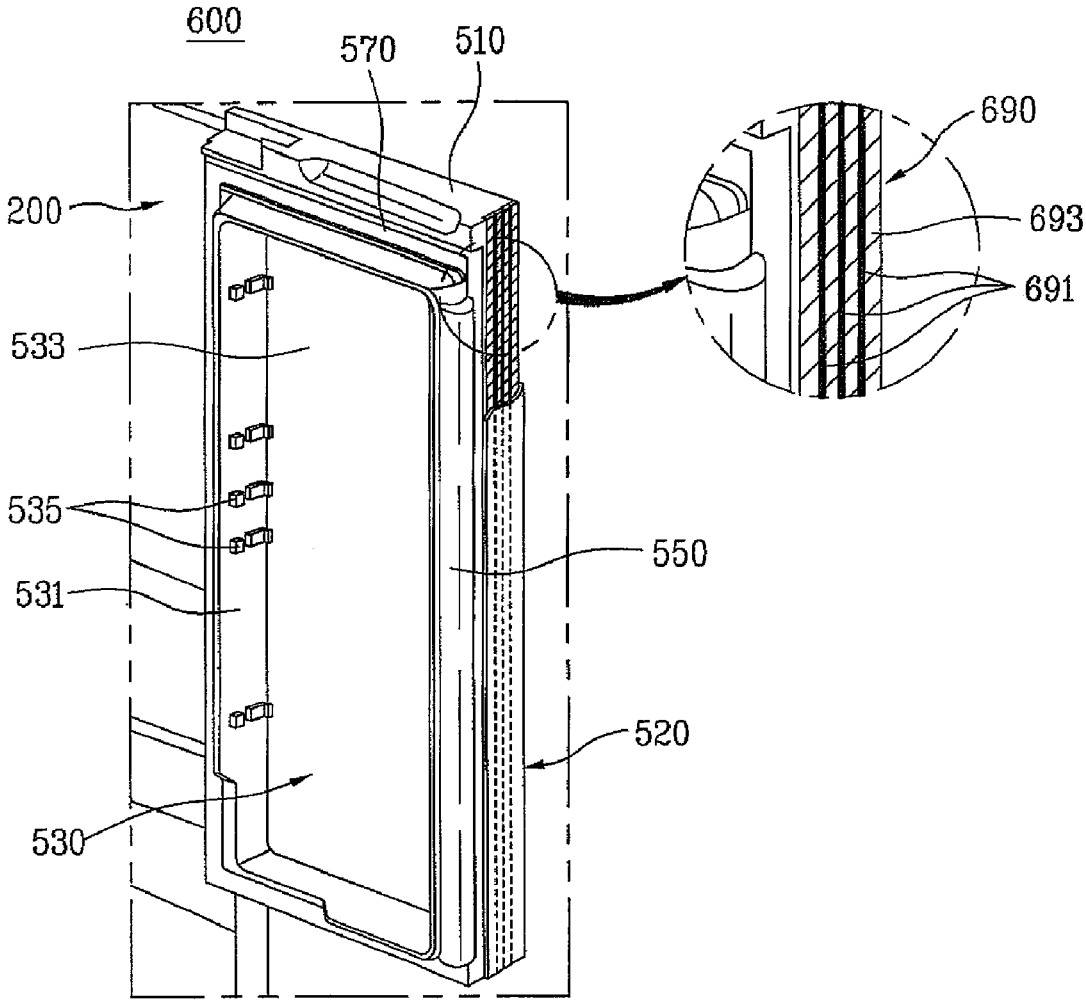
FIG. 5 illustrates a perspective view of a variation of a refrigerator door in accordance with a preferred embodiment of the present invention, with a partial cut away view.

Referring to FIG. 5, it is preferable that the outer case 520 is bent to sides where the refrigerator doors 510, and 610 face each other, to enclose the base portion 693.

The operation of the refrigerator door of the present invention will be described.

If the left, and right upper door bodies 410, and 510 are rotated to close the refrigerating chamber 200, the gaskets 550 on the left, and right upper doors 400, and 500 come into contact with each other, to close an inside of the refrigerating chamber 200.

In this instance, the elastic gaskets 550 come into close contact with each other, to compress each other, thereby minimizing a gap between the left, and right upper door bodies 410, and 510. When the left, and right upper door bodies 410, and 510 are closed, there is a gap formed between the outer cases 520 of the left, and right upper door bodies 410, and 510 in view of nature of the left, and right upper door bodies 410, and 510 which rotate thus.

Then, the heating device 590 on the inside of the one side of the outer cases 520 adjacent to, and facing each other comes into operation, to generate heat to heat the one side of the outer case 520 exposed to an outside of refrigerator.

The heating of the heating device 590 maintains a temperature of the one side of the outer case 520 constant, to remove moist, formed by a temperature difference between the cold air of the refrigerating chamber 200 and an outside of the refrigerating chamber 200, from the side of the outer case 520.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

For an example, though the embodiments describe on the upper doors 400, and 500 which close the refrigerating chamber on the upper side of the body 100, the present invention is applicable to all doors which rotate from opposite sides to close single space regardless the doors are upper doors, or lower doors, or the chamber is refrigerating chamber or the freezing chamber.

The refrigerator door of the present invention can resolve user's complaint caused by vapor condensation on facing sides of left, and right doors, taking place due to minute leakage of cold air between a gap of the gaskets, or transfer of heat from the refrigerating chamber.

Along with this, the base portion distributes heat throughout the end of the door body, to prevent the vapor condensation effectively.

Moreover, the prevention of the local temperature difference at the ends of the door bodies permits vapor condensation caused by a temperature difference depending on positions of the door bodies.

What is claimed is:

1. A refrigerator comprising:

a refrigerator compartment;

a pair of refrigerators doors configured to open and close the refrigerator compartment, the pair of refrigerator doors comprising:

a first refrigerator door defined by a first outer case and a first inner case that are configured to enclose insulating material, the first outer case defining an external appearance of the first refrigerator door when the first refrigerator door is oriented in a closed position and the first outer case having a first bent portion;

a second refrigerator door defined by a second outer case and a second inner case that are configured to enclose insulating material, the second outer case defining an external appearance of the second refrigerator door when the second refrigerator door is oriented in a closed position, the second outer case having a second bent portion, and the second bent portion of the second outer case facing the first bent portion of the first outer case when the first refrigerator door is oriented in the closed position and the second refrigerator door is oriented in the closed position;

a first gasket provided on the first refrigerator door;

a second gasket provided on the second refrigerator door, the first gasket and the second gasket being oriented such that, when the first refrigerator door is oriented in the closed position and the second refrigerator is oriented in the closed position, the first gasket contacts the second gasket and a gap exists between the first bent portion of the first outer case and the second bent portion of the second outer case; and a first heating device enclosed by the first bent portion of the first outer case and configured to generate heat to reduce vapor condensation on an exterior of at least the first bent portion of the first outer case when the first gasket contacts the second gasket and the gap exists between the first bent portion of the first outer case and the second bent portion of the second outer case, wherein the first bent portion of the first outer case has a plurality of holes configured to distribute heat generated by the first heating device to the exterior of at least the first bent portion of the first outer case when the first gasket contacts the second gasket and the gap exists between the first bent portion of the first outer case and the second bent portion of the second outer case.

2. The refrigerator as claimed in claim 1, wherein the first heating device contacts an inside surface of the first bent portion of the first outer case.

3. The refrigerator as claimed in claim 1, wherein the first heating device comprises:

a heat generating portion for generating heat; and a base portion mounted to an inner side of the first bent portion of the first outer case, the base portion contacted with the heat generating portion for making uniform distribution of the heat from the heat generating portion throughout the first bent portion of the first outer case.

4. The refrigerator as claimed in claim 3, wherein the heat generating portion is attached to the base portion.

5. The refrigerator as claimed in claim 3, wherein the heat generating portion is constructed of hot-wire.

6. The refrigerator as claimed in claim 3, wherein the base portion has grooves for receiving the heat generating portion.

7. The refrigerator as claimed in claim 3, wherein the base portion is formed of aluminum.

8. The refrigerator as claimed in claim 3, wherein the heat generating portion traverses the base portion along multiple paths on the base portion.

9. The refrigerator as claimed in claim 1, wherein the first heating device faces the first bent portion of the first outer case in an up/down direction.

10. The refrigerator as claimed in claim 1, wherein the first inner case forms an interior of a door body of the first refrigerator door.

11. The refrigerator as claimed in claim 1, further comprising a second heating device enclosed by the second bent portion of the second outer case and configured to generate heat to reduce vapor condensation on an exterior of at least the second bent portion of the second outer case when the first gasket contacts the second gasket and the gap exists between the first bent portion of the first outer case and the second bent portion of the second outer case.

12. The refrigerator as claimed in claim 11, wherein the second bent portion of the second outer case has a plurality of holes configured to distribute heat generated by the second heating device to the exterior of at least the second bent portion of the second outer case when the first gasket contacts the second gasket and the gap exists between the first bent portion of the first outer case and the second bent portion of the second outer case.

13. The refrigerator as claimed in claim 11, wherein the second heating device contacts an inside surface of the second bent portion of the second outer case.

14. The refrigerator as claimed in claim 11, wherein the second heating device comprises:

a heat generating portion for generating heat; and a base portion mounted to an inner side of the second bent portion of the second outer case, the base portion contacted with the heat generating portion for making uniform distribution of the heat from the heat generating portion throughout the second bent portion of the second outer case.

15. The refrigerator as claimed in claim 14, wherein the heat generating portion is attached to the base portion.

16. The refrigerator as claimed in claim 14, wherein the heat generating portion is constructed of hot-wire.

17. The refrigerator as claimed in claim 14, wherein the base portion has grooves for receiving the heat generating portion.

18. The refrigerator as claimed in claim 14, wherein the base portion is formed of aluminum.

19. The refrigerator as claimed in claim 14, wherein the heat generating portion traverses the base portion along multiple paths on the base portion.

20. The refrigerator as claimed in claim 11, wherein the second heating device faces the second bent portion of the second outer case in an up/down direction.

* * * * *